US007344039B2

(12) United States Patent
Bixler et al.

(10) Patent No.: US 7,344,039 B2
(45) **Date of Patent: *Mar. 18, 2008**

(54) TAMPER INDICATING BAND HAVING FOLDABLE TABS INCLUDING TAB EXTENSIONS, TAMPER INDICATING CLOSURE INCLUDING SUCH TAMPER INDICATING BAND, AND TAMPER INDICATING CLOSURE INCLUDING SUCH TAMPER INDICATING BAND AND CONTAINER

(75) Inventors: Frederick L. Bixler, Sinking Spring, PA (US); Doug Coners, Scottsville, KY (US); Don Rochow, Reading, PA (US); David F. Krueger, Drexel Hill, PA (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/752,074

(22) Filed: Jan. 5, 2004

(65) Prior Publication Data

US 2005/0189312 A1 Sep. 1, 2005

(51) Int. Cl.
*B65D 41/32* (2006.01)

(52) U.S. Cl. ..... 215/252; 215/258

(58) Field of Classification Search ..... 215/252, 215/258

See application file for complete search history.

(56) References Cited

U.S. PATENT DOCUMENTS

| | | | |
|---|---|---|---|
| 2,032,521 | A | 3/1936 | Barton |
| 2,148,468 | A | 2/1939 | Hothersall |
| 2,205,685 | A | 6/1940 | Conner |
| 3,902,630 | A | 9/1975 | Knize |
| 4,458,821 | A | 7/1984 | Ostrowsky |
| 4,470,513 | A | 9/1984 | Ostrowsky |
| 4,478,343 | A | 10/1984 | Ostrowsky |
| 4,506,795 | A | 3/1985 | Herr |
| 4,511,054 | A | 4/1985 | Shank |
| 4,546,892 | A | 10/1985 | Couput |
| 4,550,844 | A | 11/1985 | Lininger |
| 4,572,388 | A | 2/1986 | Luker et al. |

(Continued)

FOREIGN PATENT DOCUMENTS

| | | |
|---|---|---|
| AU | 647048 | 3/1991 |

(Continued)

*Primary Examiner*—Robin A. Hylton
(74) *Attorney, Agent, or Firm*—Barnes & Thornburg LLP

(57) ABSTRACT

A tamper indicating closure according to the present invention includes a top wall and a skirt depending from the top wall. A tamper indicating band is connected to the skirt along a frangible line. The tamper indicating band includes a ring and at least one tab, the at least one tab having a bi-stable geometric shape. In particular, the tab includes a pair of extending members angled toward one another and connected by a transverse member. The shape of the tab allows it to be molded in a downward orientation and later folded to a stable, upward orientation without reheating or otherwise resetting the tab. The tab also includes a tab extension arranged on at least one of the transverse member and at least one extending member of at least one tab and extending in a direction of extension of the extending members from at least one tab, the tab extension configured to engage at least one container profile.

25 Claims, 18 Drawing Sheets

U.S. PATENT DOCUMENTS

| | | | | |
|---|---|---|---|---|
| 4,576,299 | A | 3/1986 | Lecinski, Jr. | |
| 4,595,110 | A | 6/1986 | Herr | |
| 4,595,547 | A | 6/1986 | Herr | |
| 4,598,833 | A | 7/1986 | Herr | |
| 4,643,321 | A | 2/1987 | Gach | |
| 4,653,657 | A | 3/1987 | Papavasilopoulos | |
| 4,657,153 | A | 4/1987 | Hayes | |
| 4,732,289 | A | 3/1988 | Granat et al. | |
| 4,789,076 | A | 12/1988 | Jewitt et al. | |
| 4,796,770 | A | 1/1989 | Begley | |
| 4,801,030 | A | 1/1989 | Barriac | |
| 4,801,031 | A | 1/1989 | Barriac | |
| RE32,879 | E | 2/1989 | Wright et al. | |
| 4,807,771 | A | 2/1989 | Roy et al. | |
| 4,813,561 | A | 3/1989 | Ochs | |
| 4,848,614 | A | 7/1989 | Csaszar | |
| 4,863,030 | A | 9/1989 | Bayer et al. | |
| 4,875,594 | A | 10/1989 | Ochs | |
| 4,938,370 | A | 7/1990 | McBride | |
| 4,978,016 | A | 12/1990 | Hayes | |
| 4,978,017 | A | 12/1990 | McBride | |
| 4,981,230 | A | 1/1991 | Marshall et al. | |
| 4,997,097 | A | 3/1991 | Krautkramer | |
| 5,007,545 | A | 4/1991 | Imbery, Jr. | |
| 5,050,753 | A | 9/1991 | Trump et al. | |
| 5,054,268 | A | 10/1991 | Hayes et al. | |
| 5,058,755 | A | 10/1991 | Hayes | |
| 5,080,246 | A | 1/1992 | Hayes | |
| 5,090,788 | A | 2/1992 | Ingram et al. | |
| 5,096,079 | A * | 3/1992 | Odet | 215/252 |
| 5,129,530 | A | 7/1992 | Fuchs | |
| 5,167,335 | A | 12/1992 | McBride et al. | |
| 5,197,620 | A | 3/1993 | Gregory | |
| 5,205,426 | A | 4/1993 | McBride et al. | |
| 5,219,507 | A | 6/1993 | Ingram et al. | |
| 5,282,540 | A | 2/1994 | Beck | |
| 5,295,600 | A | 3/1994 | Kowal | |
| 5,310,069 | A | 5/1994 | Ingram et al. | |
| 5,370,520 | A | 12/1994 | Ingram et al. | |
| 5,397,009 | A | 3/1995 | Salmon et al. | |
| 5,443,171 | A | 8/1995 | Sprowl | |
| 5,450,973 | A | 9/1995 | Ellis et al. | |
| 5,462,184 | A | 10/1995 | Ingram et al. | |
| 5,488,888 | A | 2/1996 | Kowal | |
| 5,582,308 | A | 12/1996 | Kishi et al. | |
| 5,611,446 | A | 3/1997 | Ingram et al. | |
| 5,657,889 | A | 8/1997 | Guglielmini | |
| 5,667,087 | A | 9/1997 | Delatour et al. | |
| 5,676,269 | A | 10/1997 | Blake et al. | |
| 5,678,714 | A | 10/1997 | Guglielmini | |
| 5,685,443 | A | 11/1997 | Taber et al. | |
| 5,690,882 | A | 11/1997 | Sprowl | |
| 5,749,484 | A * | 5/1998 | Trout | 215/219 |
| 5,755,347 | A | 5/1998 | Ingram | |
| 6,371,317 | B1 | 4/2002 | Krueger | |
| 6,581,792 | B1 * | 6/2003 | Limanjaya | 215/252 |
| 6,673,298 | B2 | 1/2004 | Krueger | |

FOREIGN PATENT DOCUMENTS

| | | |
|---|---|---|
| AU | 648537 | 10/1991 |
| AU | 650056 | 3/1992 |
| DE | 41 08 453 | 10/1991 |
| EP | 0 390 412 | 10/1990 |
| WO | WO 91/03405 | 3/1991 |

* cited by examiner

TAMPER INDICATING BAND HAVING FOLDABLE TABS INCLUDING TAB EXTENSIONS, TAMPER INDICATING CLOSURE INCLUDING SUCH TAMPER INDICATING BAND, AND TAMPER INDICATING CLOSURE INCLUDING SUCH TAMPER INDICATING BAND AND CONTAINER

FIELD OF THE INVENTION

The present invention relates to container closures, and in particular to closures including tamper indication such as a tamper indicating band.

BACKGROUND INFORMATION

Tamper indicating closures for bottles and other containers are designed to indicate to the consumer when the container has been opened or otherwise tampered with. Known tamper indicating closures typically include a flat, circular closure top and an annular skirt depending downwardly from the outer rim of the closure top. The inner surface of the skirt portion includes threads which interact with a threaded portion of the container neck to retain the closure on the container.

Tamper indicating closures also typically include a tamper indicating band connected to the bottom of the skirt along a frangible line or joint. The tamper indicating band is generally an annular member which may have a plurality of inwardly and upwardly extending tabs that are retained beneath an annular shoulder on the neck of the container. When the closure is removed from the container for the first time, the tabs contact the shoulder and cause the tamper indication band to separate from the skirt along the frangible line.

With many known tamper indicating closures, the closure top, skirt, and tamper indicating band are formed integrally. However, due to the complexity and shape of the tamper indication closure, the tabs must often be formed facing downwardly, and later folded upwards. In some cases, this method of manufacturing may require reheating of the closure to set the tabs in an upward and inward position, adding to manufacturing time and costs.

In an effort to avoid this problem, some closures are formed with foldable arrangements. Known foldable arrangements, however, are often formed as unitary, foldable bands spanning the circumference of the closure, rather than individual tabs (see, for example, U.S. Pat. No. 4,546,892 to Couput). These foldable bands, and similar arrangements in which the foldable bands are broken up into large segments, can be difficult to fold. To the extent folding is achieved, the folding process can bend and deform the relatively large bands and segments, decreasing the structural integrity and hence the reliability of the tamper indicating mechanism. Other foldable closures group a plurality of tabs with bridging elements (see, for example, U.S. Pat. No. 4,981,230 to Marshall et al.). These groups may suffer the same drawbacks as the foldable bands described above. Alternatively, the groups may require relatively weak bridges which can rupture, again decreasing the structural integrity and reliability of the mechanism.

SUMMARY

An example embodiment of the present invention provides a tamper indicating closure, which includes a top wall, a skirt depending from the top wall, and a tamper indicating band. The tamper indicating band is connected to the skirt along a frangible line. The tamper indicating band includes a ring and a plurality of tabs having a bi-stable geometric shape. Each tab includes a pair of extending members angled toward one another and connected by a transverse member, forming a generally trapezoidal shape. The shape of the tab allows it to be molded in a downward orientation and later folded to a stable, upward orientation, without requiring reheating or other remolding of the closure or tab.

According to an example embodiment of the present invention, the tabs may include tab extensions arranged on a center portion of the transverse member, which extend to engage a container profile. In this regard, the tab extensions may be designed to fit a number a different profiles so that the closure need not be re-designed to accommodate multiple profiles. As such, the tab extension may provide further stability and prevent unfolding resulting in a "tiring off" and a loss of tamper evidence.

According to an example embodiment, a tamper indicating band for a closure may include a plastic ring, a plurality of plastic trapezoidal tabs disposed on the ring, each having a transverse member and extending members, a maximum thickness of the transverse member being substantially equal to a maximum thickness of a tip of each extending member when said. Thickness are measured in the same direction, and each of the tabs having a trapezoidal hole therethrough, each of the tabs formed in a downward direction and constructed to fold to a stable inward and upward orientation, and a tab extension arranged on at least one of the transverse member and at least one extending member of at least one tab and extending in a direction of extension of the extending members from the at least one tab, the tab extension configured to engage at least one container profile.

According to an example embodiment, the trapezoidal hole may be located at a base of the trapezoidal tab.

According to an example embodiment, the plurality of tabs may be arranged circumferentially around the ring.

According to an example embodiment, each of the tabs may gradually thicken in a direction toward a tip of the extending members.

According to an example embodiment, the plurality of tabs may be spaced apart from one another along the ring.

According to an example embodiment, a tamper indicating closure for a container may include a top wall, an annular skirt depending from the top wall, the annular skirt including an internal thread, and a tamper indicating band connected to the skirt along a frangible line, the tamper indicating band including a plastic ring, a plurality of plastic tabs each connected to the ring at a base, each of the tabs including a pair of extending members angled toward each other and joined by a transverse member having a maximum thickness substantially equal to a maximum thickness of a tip of each extending member when said thickness are measured in the same direction, each of the tabs formed in a downward orientation and constructed to fold to a stable inward and upward orientation, and a tab extension arranged on at least one of the transverse member and at least one extending member of at least one tab and extending in a direction of extension of the extending members from the at least one tab, the tab extension configured to engage at least one container profile.

According to an example embodiment, a tamper indicating closure and container may include a container having a cylindrical neck, the neck including an external thread and a shoulder below the external thread, and a closure, including a top wall, an annular skirt depending from the top wall, the annular skirt including an internal thread, and a tamper indicating band connected to a bottom edge of the skirt along a frangible line, the tamper indicating band including a plastic ring, and a plurality of plastic tabs each connected to the ring at a base, each of the tabs including a pair of extending members angled toward each other and joined by a transverse member having a maximum thickness substantially equal to a maximum thickness of a tip of each extending member when said thickness are measured in the same direction, each of the tabs formed in a downward orientation and constructed to fold to a stable inward an upward orientation, and a tab extension arranged on at least one of the transverse member and at least one extending member of at least one tab and extending in a direction of extension of the extending members from the at least one tab, the tab extension configured to engage at least one container profile, wherein the tabs and the tab extensions are arranged to lock under the container shoulder when closure is applied to the container, the tabs and the tab extensions arranged to contact the shoulder when the closure is removed so that the tamper indicating band separates from the skirt along the frangible line.

According to an example embodiment, a tamper indicating closure for a container may include a top wall, an annular skirt depending from the top wall, the annular skirt including an internal thread, and a tamper indicating band connected to the skirt along a frangible line, the tamper indicating band including a plastic ring, and a plurality of plastic tabs each connected to the ring at a base, each of the tabs including a pair of extending member angled toward each other and joined by a transverse member having a maximum thickness substantially equal to a maximum thickness of a tip of each extending member when said thickness are measured in the same direction, each of the tabs formed in a downward orientation and constructed to fold to a stable inward and upward orientation, and a tab extension arranged on at least one of the transverse member and at least one extending member of at least one tab and extending in a direction of extension of the extending members from the at least one tab, the tab extension configured to engage at least one container profile.

According to an example embodiment, a tamper indicating band for a closure may comprise a ring, a plurality of tabs each connected to the ring at a base, the tabs including a pair of extending members angled toward each other and joined by a transverse member, the tab formed in a downward orientation and constructed to fold to a stable inward and upward orientation, and a tab extension arranged on at least one of the transverse member and at least one extending member of at least one tab and extending in a direction of extension of the extending members from the at least one tab, the tab extension configured to engage at least one container profile.

According to an example embodiment, a tamper indicating band for a closure may include a ring, a plurality of trapezoidal tabs disposed on the ring, each having a trapezoidal hole therethrough, the tabs formed in a downward orientation and constructed to fold to a stable inward and upward orientation, and a tab extension arranged on at least one tab extending in a direction of extension of the at least one tab and configured to engage at least one container profile.

According to an example embodiment, a tamper indicating closure for a container may include a top wall, an annular skirt depending from the top wall, the annular skirt including an internal thread, and a tamper indicating band connected to the skirt along a frangible line, the tamper indicating band including a ring, a plurality of tabs each connected to the ring at a base, the tabs including a pair of extending members angled toward each other and joined by a transverse member, the tab formed in a downward orientation and constructed to fold to a stable inward and upward orientation, and a tab extension arranged on at least one of the transverse member and at least one extending member of at least one tab and extending in a direction of extension of the extending members from the at least one tab, the tab extension configured to engage at least one container profile.

According to an example embodiment, a tamper indicating closure and container may include a container having a cylindrical neck, the neck including an external thread and a shoulder below the external thread, and a closure, including a top wall, an annular skirt depending from the top wall, the annular skirt including an internal thread, and a tamper indicating band connected to a bottom edge of the skirt along a frangible line, the tamper indicating band including a ring, a plurality of tabs each connected to the ring at a base, the tabs including a pair of extending members angled toward each other and joined by a transverse member, the tab formed in a downward orientation and constructed to fold to a stable inward and upward orientation, and a tab extension arranged on at least one of the transverse member and at least one extending member of at least one tab and extending in a direction of extension of the extending members from at least one tab, the tab extension configured to engage at least one container profile, wherein the tabs and the tab extensions are configured to lock under the container shoulder when the closure is applied to the container and contact the shoulder when the closure is removed so that the tamper indicating band separates from the skirt along the frangible line.

An example method of producing a tamper indicating closure may include molding a closure including a top wall, a skirt, and a tamper indicating band, the tamper indicating band including a ring, a plurality of tabs each connected to the ring at a base, and at least one tab extension, the tabs including a pair of extending members angled toward each other and joined by a transverse member, the at least one tab<extension arranged on at least one of the transverse member and at least one extending member and extending in a direction of extension of the extending members, the at least one tab extension configured to engage at least one container profile, each of the plurality of tabs being molded in a downward orientation, and folding the tabs to a stable inward and upward orientation.

An example embodiment and/or example method may ensure that the tabs of the closure are in a proper locking position under the container's locking profile, and may prevent the closure's locking tabs from prematurely stopping before they arrive at a final locking position, and may compensate for a container's locking profile variations which may not conform to industry standards.

DETAILED DESCRIPTION

Figure 1:
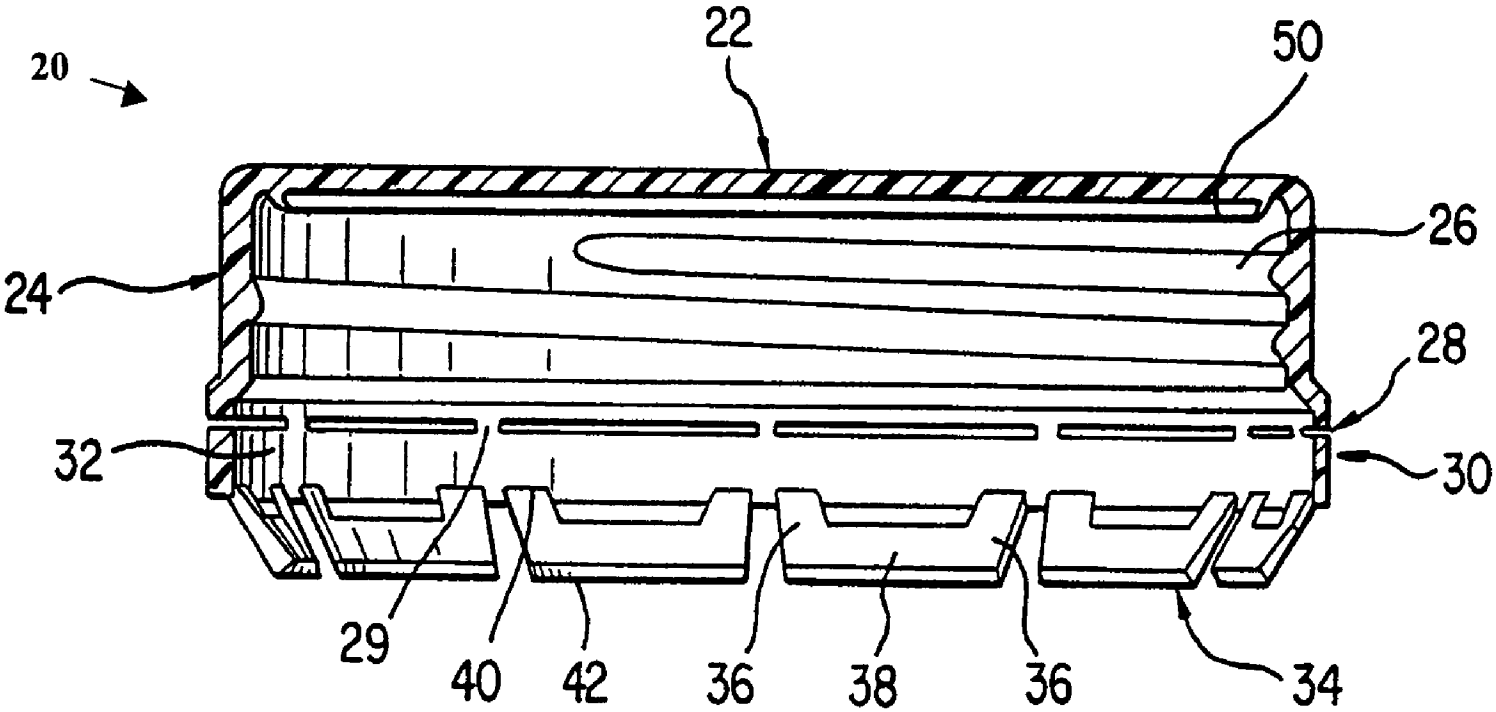
FIG. 1 is a side cross-sectional view of an exemplary closure according to the present invention having tabs in a downward orientation.
Figure 7:
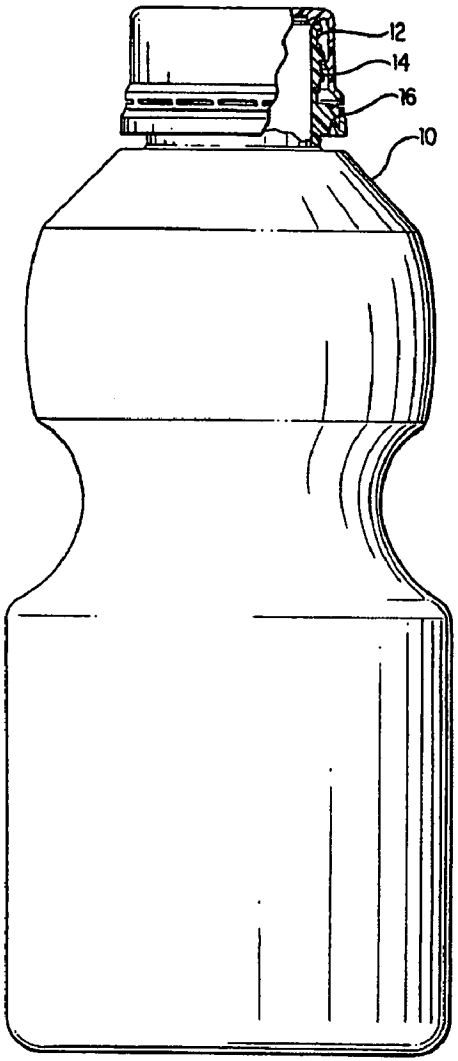
FIG. 7 is a side view of an exemplary container according to the present invention.
Figure 8:
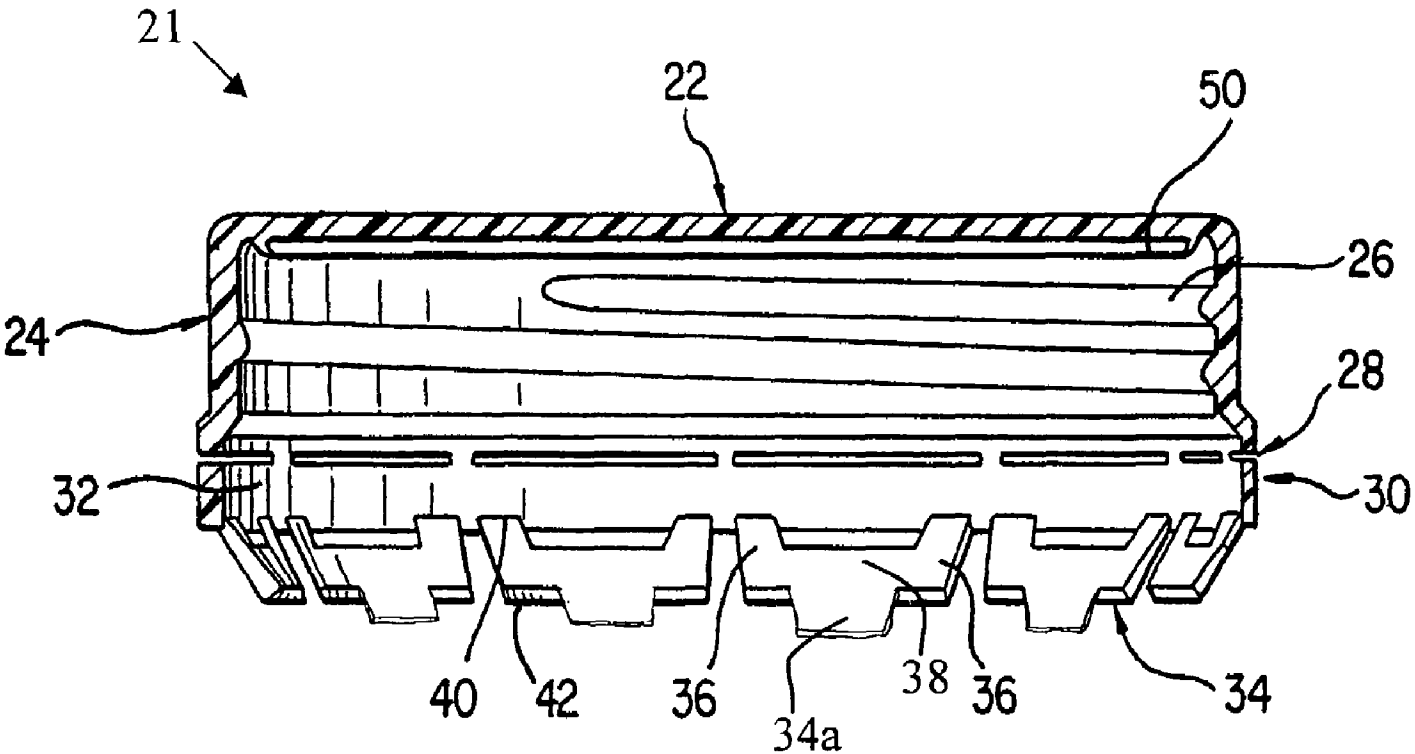
FIG. 8 is a side cross-sectional view of an exemplary closure according to the present invention having tabs in a downward orientation and including tab extensions.
Figure 9:
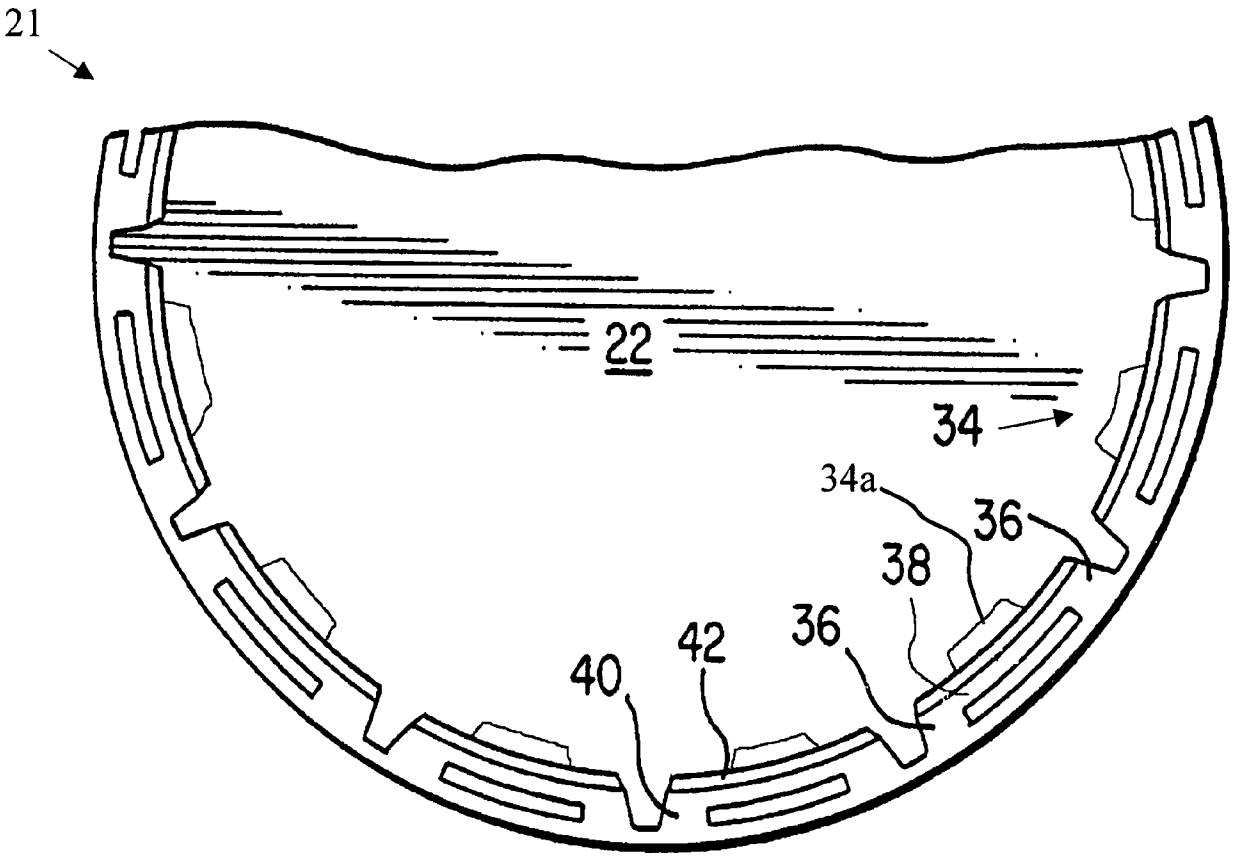
FIG. 9 is a bottom view of the closure of FIG. 8.
Figure 10:
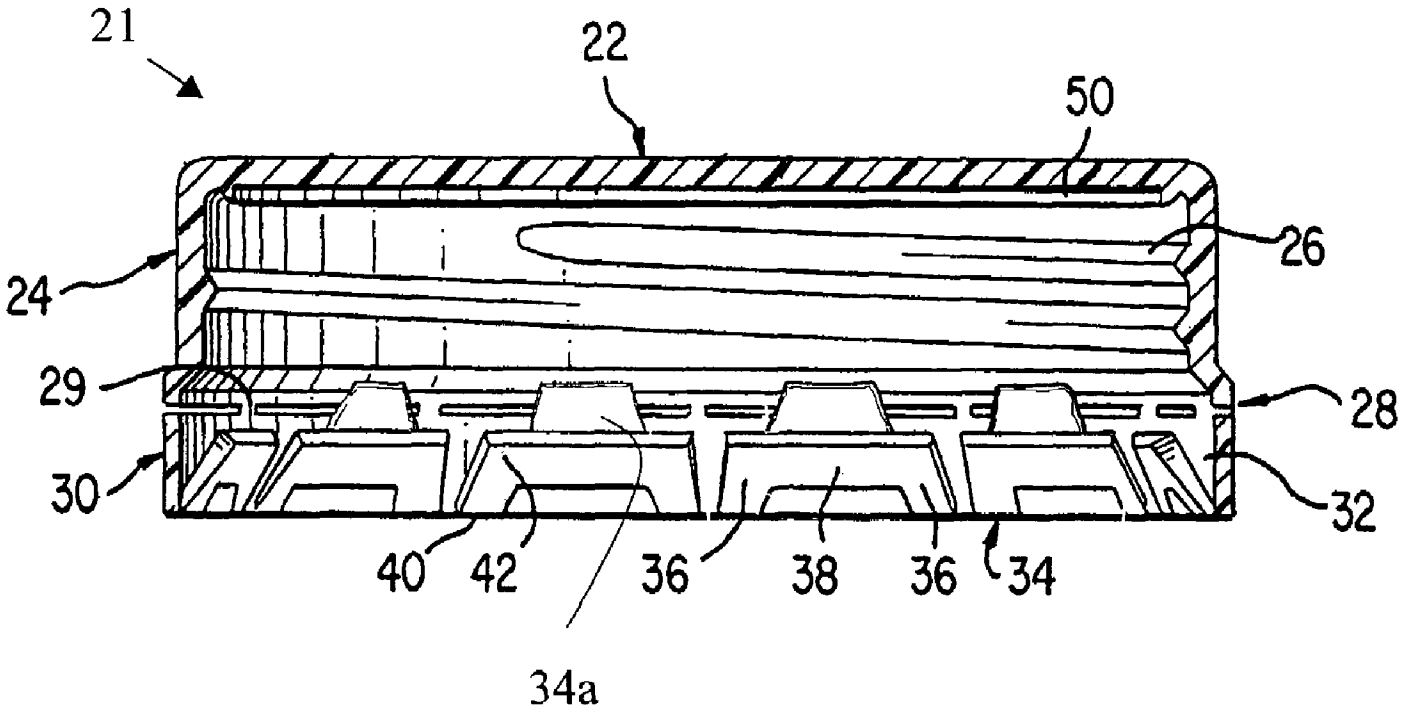
FIG. 10 is a side cross-sectional view of an exemplary closure according to the present invention having tabs in an upward orientation and including tab extensions.
Figure 11:
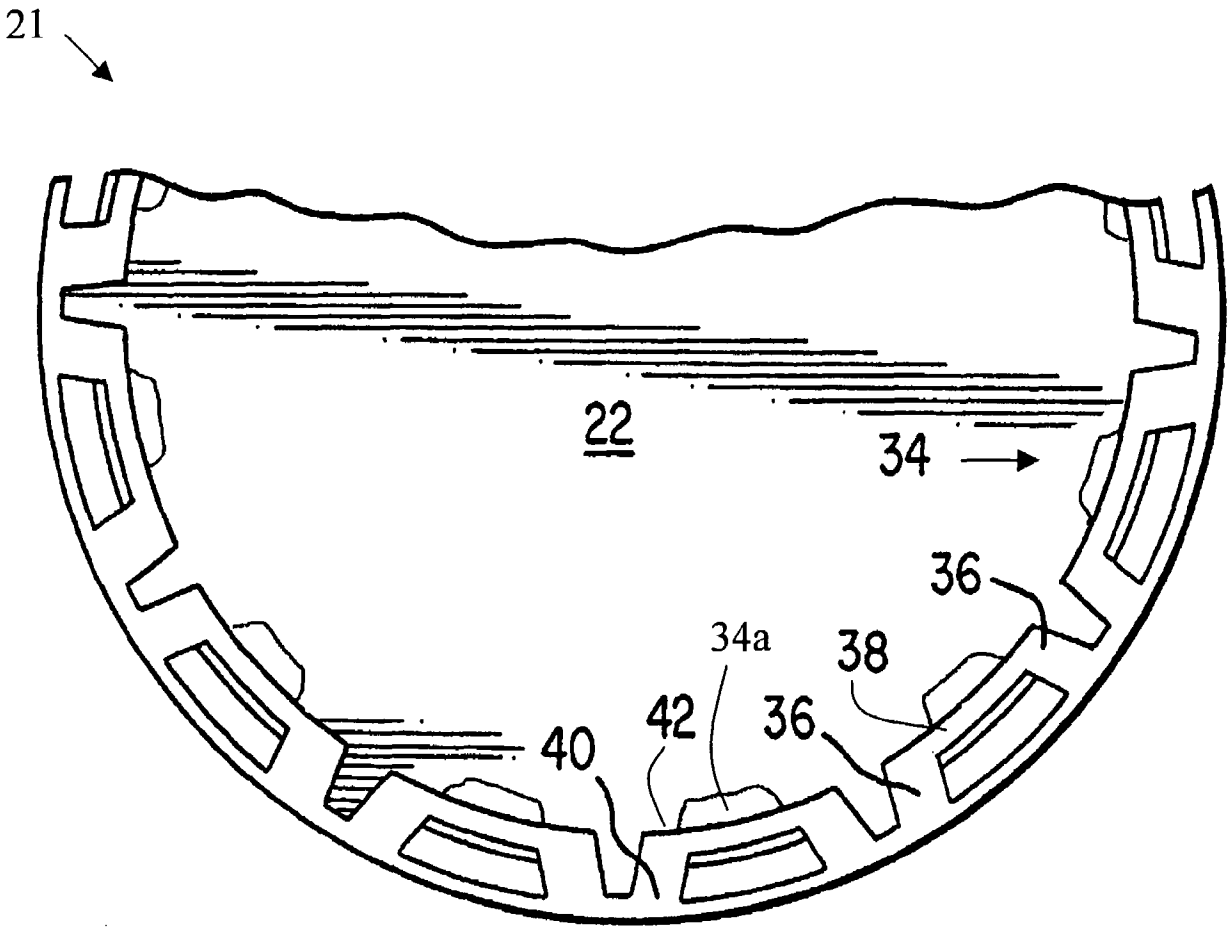
FIG. 11 is a bottom view of the closure of FIG. 10.
Figure 12:
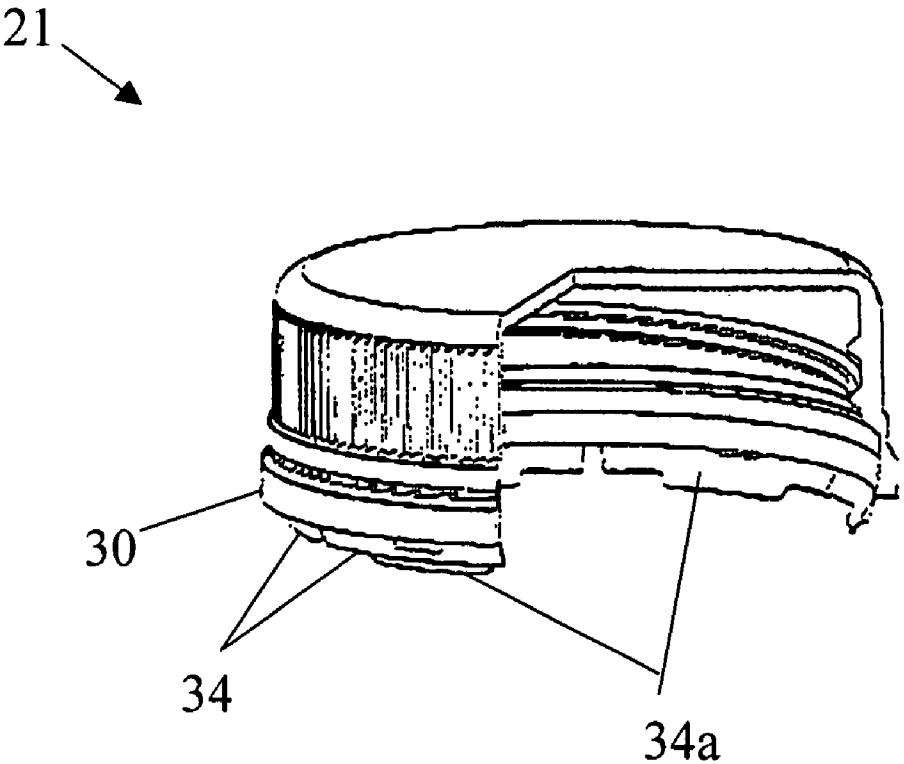
FIG. 12 is a perspective view of an exemplary closure according to the present invention having tabs in an downward orientation and including tab extensions.
Figure 13:
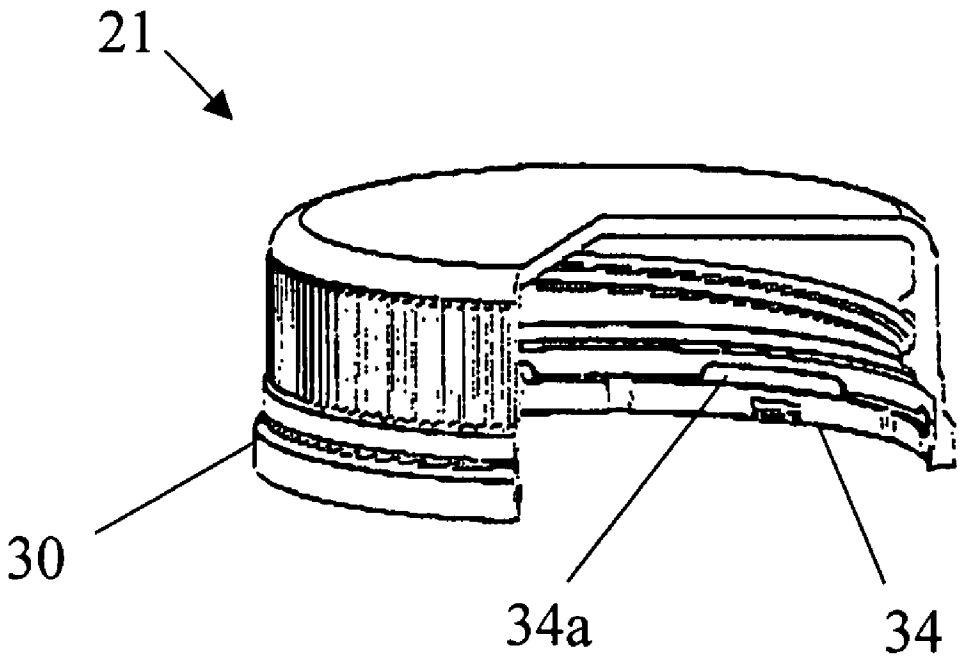
FIG. 13 is a perspective view of an exemplary closure according to the present invention having tabs in an upward orientation and including tab extensions.

FIG. 1 illustrates a closure 20 according to an example embodiment of the present invention, which includes a plurality of tabs 34 whose geometric shape allows each tab 34 to be folded upward to a stable position without requiring reheating, remolding or otherwise resetting the tab 34. In general, closure 20 includes a top wall 22, a skirt 24, and a tamper indicating band 30. Top wall 22 may be circular in shape, although any suitable shape may be used. Closure 20 also includes a skirt 24, for example an annular skirt 24, depending from the top wall 22. In the illustrated embodiment, skirt 24 depends from the outer edge of top wall 22, but top wall 22 may extend beyond skirt 24 if desired. Skirt 24 includes, for example, at least one internal thread 26 that cooperates with an external thread 14 on container 10 (shown in FIG. 7) to retain closure 20 on container 10. While the illustrated embodiment includes internal and external threads 26 and 14, any suitable retention formation, such as locking lugs, may be provided. The terms "internal thread" and "external thread" should be read to include these alternative formations.

Tamper indicating band 30 is connected to skirt 24 along a frangible line 28. Tamper indicating band 30 may be connected to skirt 24 at the bottom of skirt 24, as illustrated in FIG. 1. Frangible line 28 may include any type of frangible formation, for example a score line along the entire circumference or a series of score lines each encompassing a segment of the circumference. In the illustrated embodiment, frangible line 28 includes a plurality of bridges 29. Bridges 29 may be formed during the original molding of closure 20, but frangible line 28 may be molded as a solid line. The areas between bridges 29 are then created by scoring, as described, for example, in U.S. Pat. No. 4,595,547, whose disclosure is incorporated herein by reference.

Tamper indicating band 30 includes ring 32, which may be annular in shape. Tamper indicating band 30 also includes at least one tab 34, such as, for example, a plurality of tabs 34 arranged circumferentially around ring 32. Tabs 34 are spaced slightly apart, as illustrated in FIG. 1. Each tab 34 generally includes a pair of extending members 36 connected by a transverse member 38, with the extending members 36 of each tab 34 being angled inwardly toward each other. Extending members 36 each are connected to ring 32 at a base 40 of the extending member.

Figure 5:
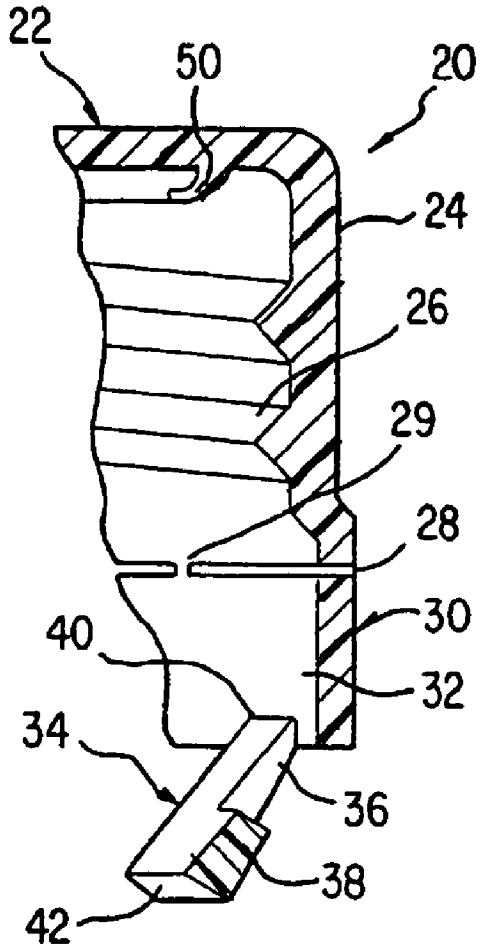
FIG. 5 is a cross-sectional view of an exemplary closure and tab according to the present invention.
Figure 6:
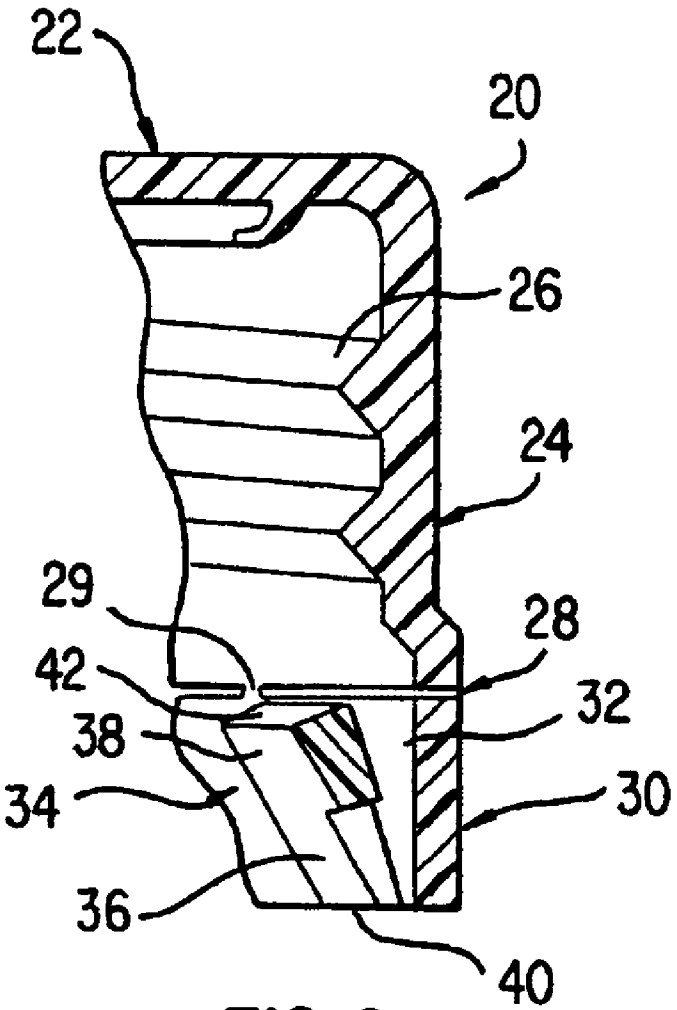
FIG. 6 is another cross-sectional view of the closure of FIG. 5, with the tab in the upward orientation.

Each tab 34 is a generally trapezoidal member having a generally trapezoidal hole therethrough. The trapezoidal hole may be located at the base of tab 34, rather than, for example, in the center of tab 34. The resulting structure comprises the two extending members 36 and transverse member 38. In an example embodiment, each tab 34 is relatively thin at its base 40 and gradually thickens moving toward tip 42, as illustrated in FIGS. 5 and 6.

Figure 2:
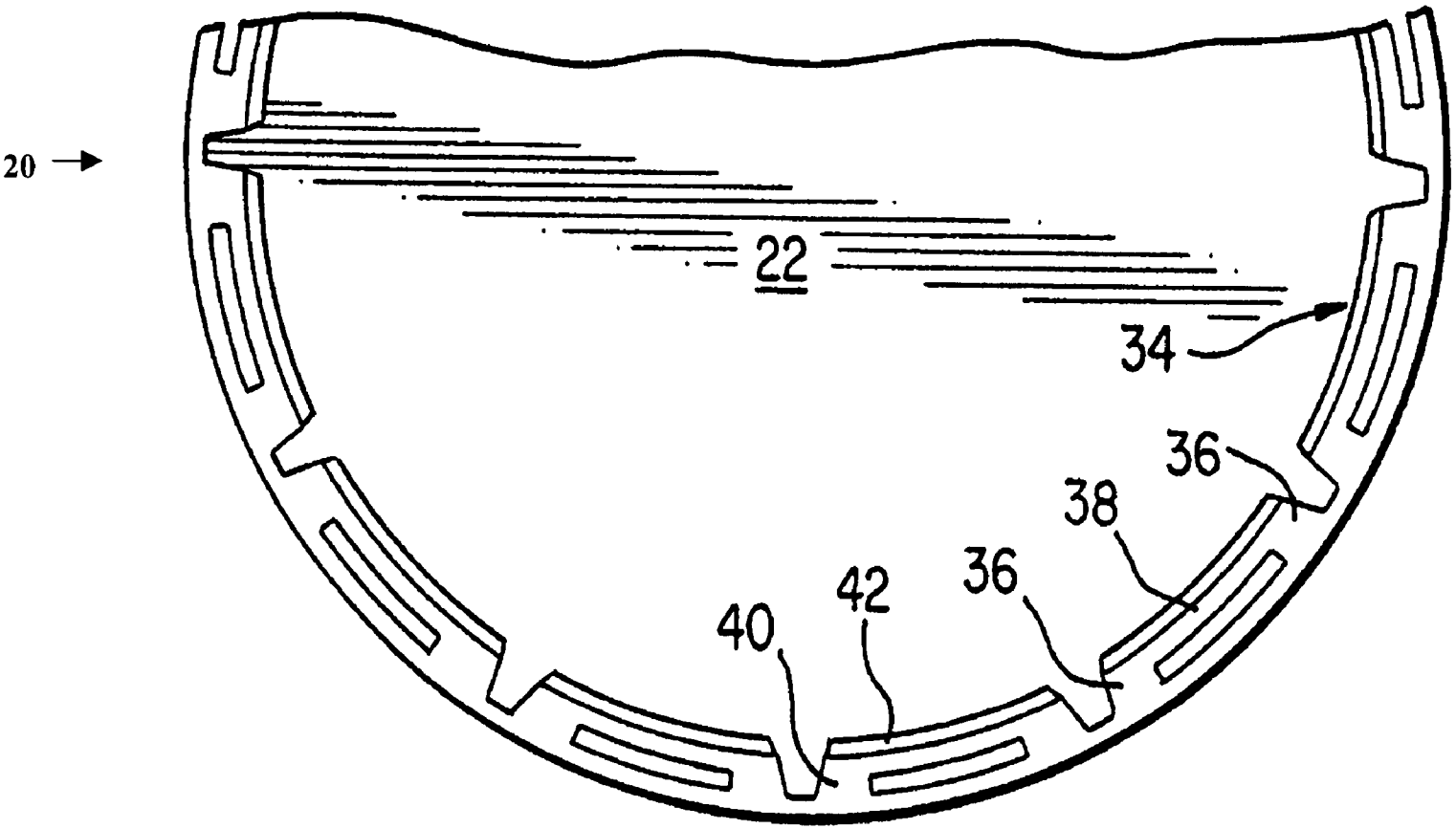
FIG. 2 is a bottom view of the closure of FIG. 1.

The geometric shape of tab 34 creates a bi-stable configuration that has equilibrium positions in both a downward orientation and an upward orientation. In particular, tamper indicating band 30 may be molded with tabs 34 in the downward and inward orientation, for example at approximately 60° from the horizontal. This configuration is illustrated in FIGS. 1, 2 and 5. As noted above, molding tabs 34 in the downward orientation provides manufacturing advantages compared to molding tabs 34 in an upward orientation.

Figure 3:
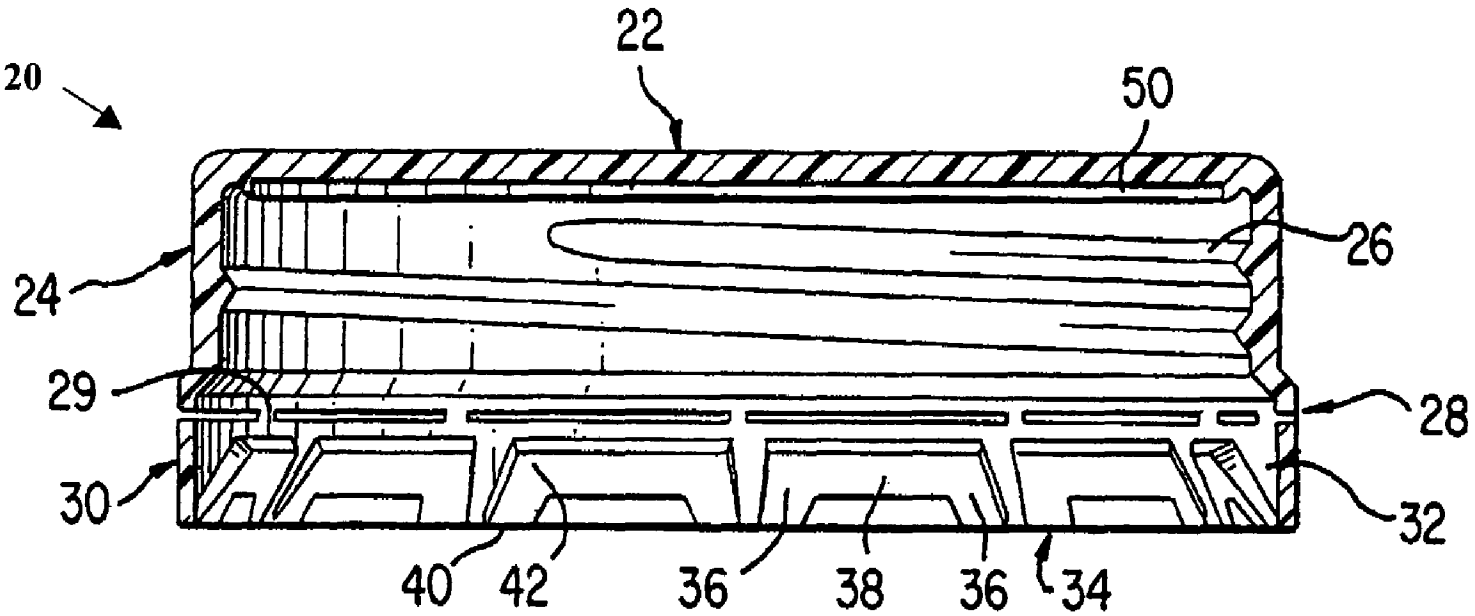
FIG. 3 is a side cross-sectional view of an exemplary closure according to the present invention having tabs in an upward orientation.
Figure 4:
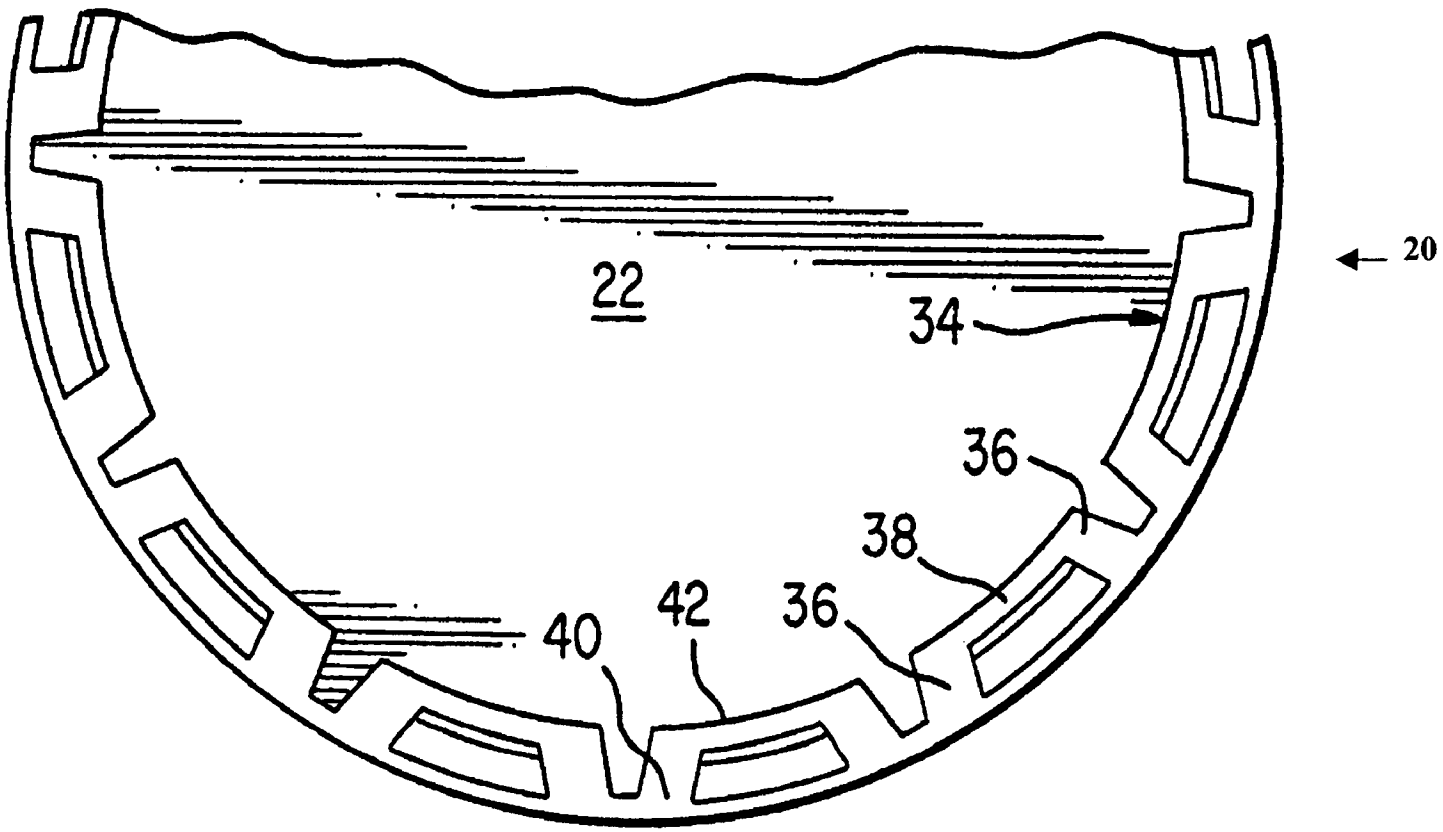
FIG. 4 is a bottom view of the closure of FIG. 3.

After molding, tabs 34 may be folded to an upward orientation. Because transverse member 38 is relatively thick compared to the base of each extending member 36, it does not tend to compress or flex significantly during folding. Rather, the folding action biases extending members 36 outwardly away from one another as tab 34 approaches the horizontal. At a point near the horizontal, extending members 36 are at a maximum outward angle. Once past the horizontal, continued upward motion tends to return extending members 36 to their original, inwardly-directed angle. Accordingly, as tab 34 is first moved upward, the tendency of extending members 36 to return to their original angle biases tab 34 toward the downward orientation. If tab 34 were released prior to reaching the horizontal, it would return to the downward orientation. However, once tab 34 passes a point approximately at the horizontal, then it will become biased toward the upward orientation. When tab 34 is released after passing this point, it will move toward the stable upward orientation, for example approximately 60° above the horizontal. This position is illustrated in FIGS. 3, 4 and 6.

With tabs 34 in the upward orientation, closure 20 can be applied to container 10, and tabs 34 may be biased further upward to pass over shoulder 16 of the container. Once past shoulder 16, tabs 34 may return to the normal upward orientation and lock under shoulder 16. In this position, tabs 34 may contact neck 12, shoulder 16, or both. Alternatively, tabs 34 may rest just under shoulder 16 without contacting shoulder 16 or neck 12. When closure 20 is removed, tabs 34 will contact shoulder 16 to prevent tamper indicating band 30 from removal from container 10 with the remainder of closure 20. Tamper indicating band 30 will therefore separate from skirt 24 along frangible line 28, providing tamper indication.

FIGS. 8 through 14 illustrate a closure 21 according to an example embodiment of the present invention, which includes a plurality of tab extensions 34*a* arranged circumferentially on the tip 42 of each tab 34. The tab extensions 34*a* extend away from the tip 42 along a plane defined by the extending members 36 and transverse member 38 of each tab 34. In an example embodiment, each tab extension 34*a* is wedge-shaped or trapezoidal and extends from a center portion of the transverse member 38. The tab extensions 34*a* are configured to engage a container profile to provide further stability and to prevent unfolding resulting in a "tiring off" of the tamper indicating band 30 and a loss of tamper evidence. It will be appreciated that the size and shape of the tab extension 34*a* may be configurable to suit the appropriate container profile and/or to provide the appropriate stability and function. For example, the tab extension 34*a* may be configured to any length or width and may shaped in any suitable form, including, for example, rectangular, square, trapezoidal, cuboid, wedge-shaped, pyramid-shaped, curve-shaped, bell-shaped, tetragon-shaped, multi-faceted, etc. Moreover, the edges of the tab extension 34*a* may be smooth or non-smooth, including, for example, toothed, forked, crenellated, pointed, etc. As illustrated, for example in FIG. 14, the tab extensions 34*a* may have a thickness substantially less than the thickness of the tabs 34.

Figure 14:
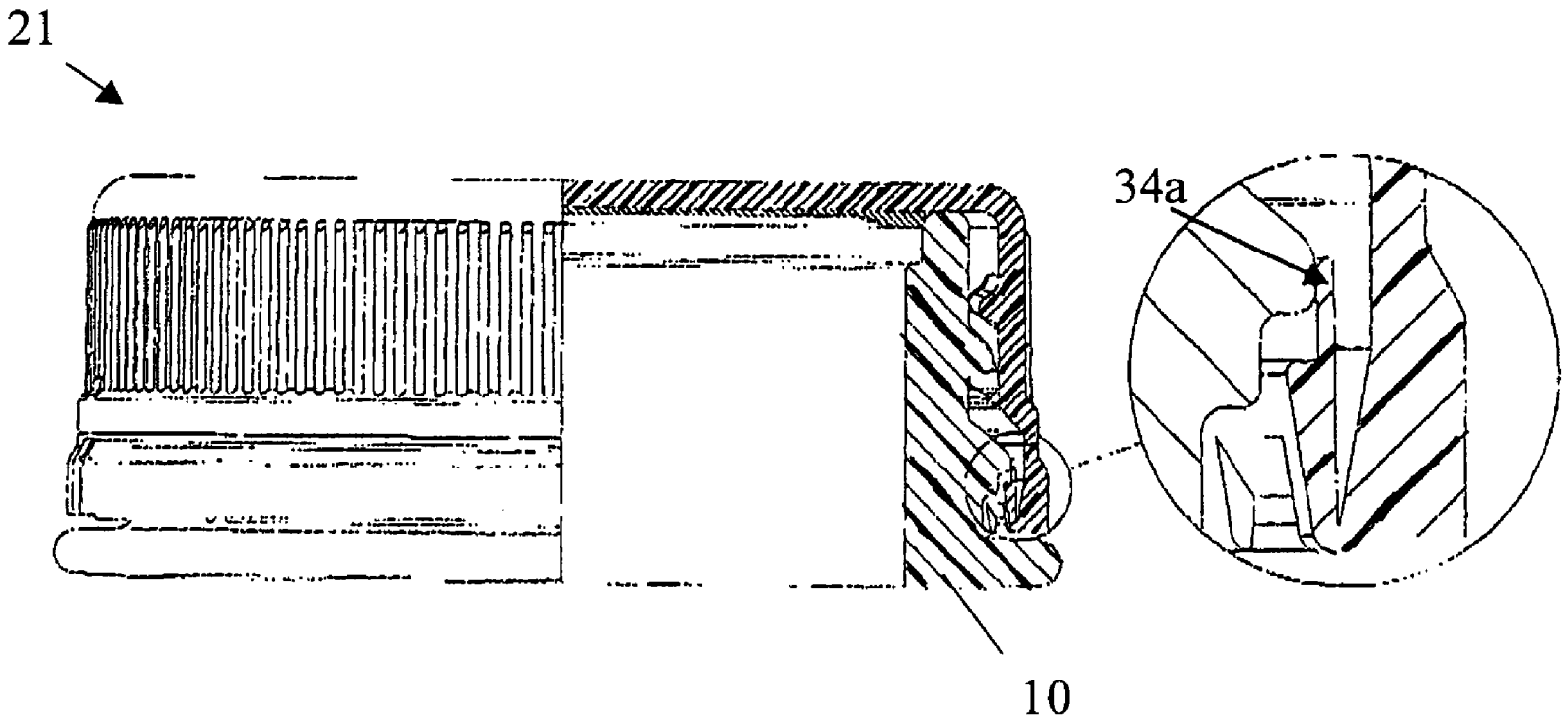
FIG. 14 is a cross-sectional view of an exemplary closure according to the present invention engaged with a container.
Figure 15:
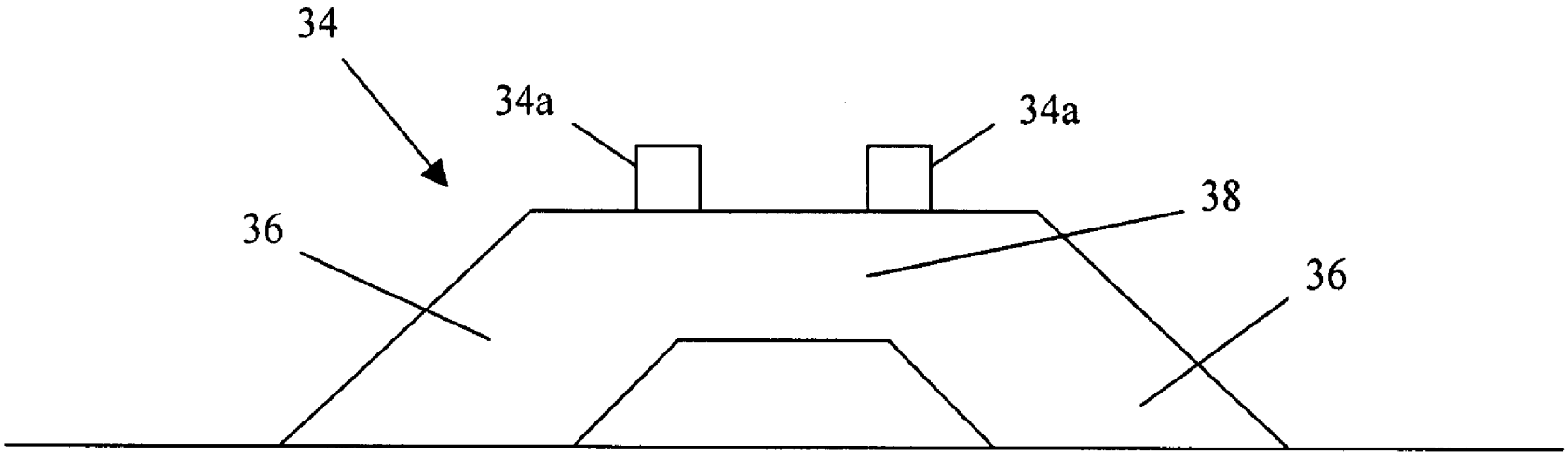
FIG. 15 is a side view of an exemplary tab extension configuration according to the present invention in which multiple tab extensions are arranged on a single tab.
Figure 16:
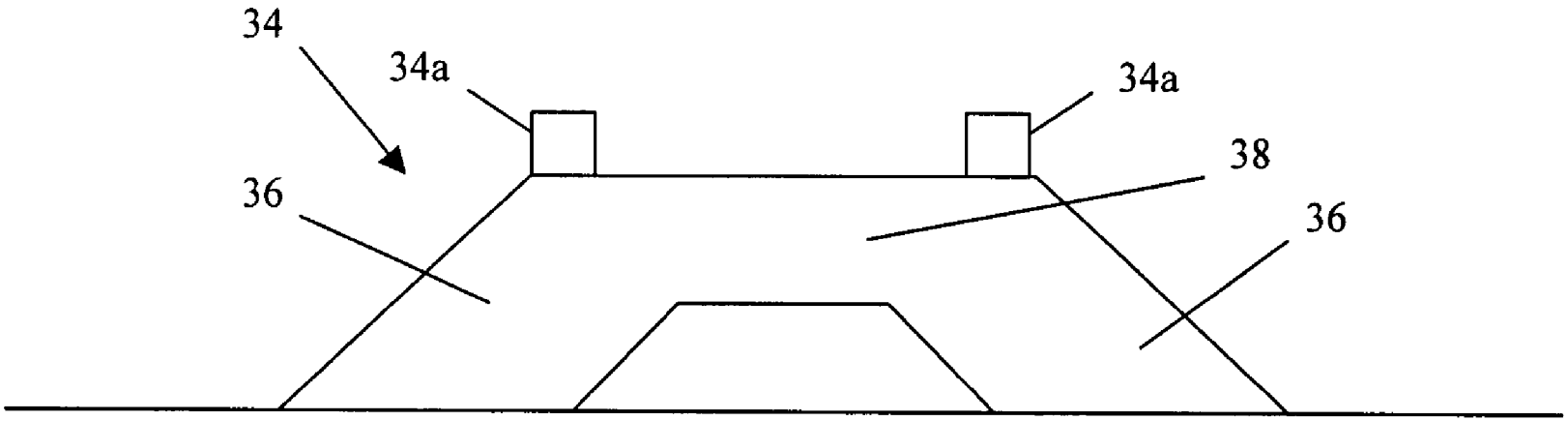
FIG. 16 is a side view of an exemplary tab extension configuration according to the present invention in which two tab extensions are arranged on opposite ends of a single tab.
Figure 17:
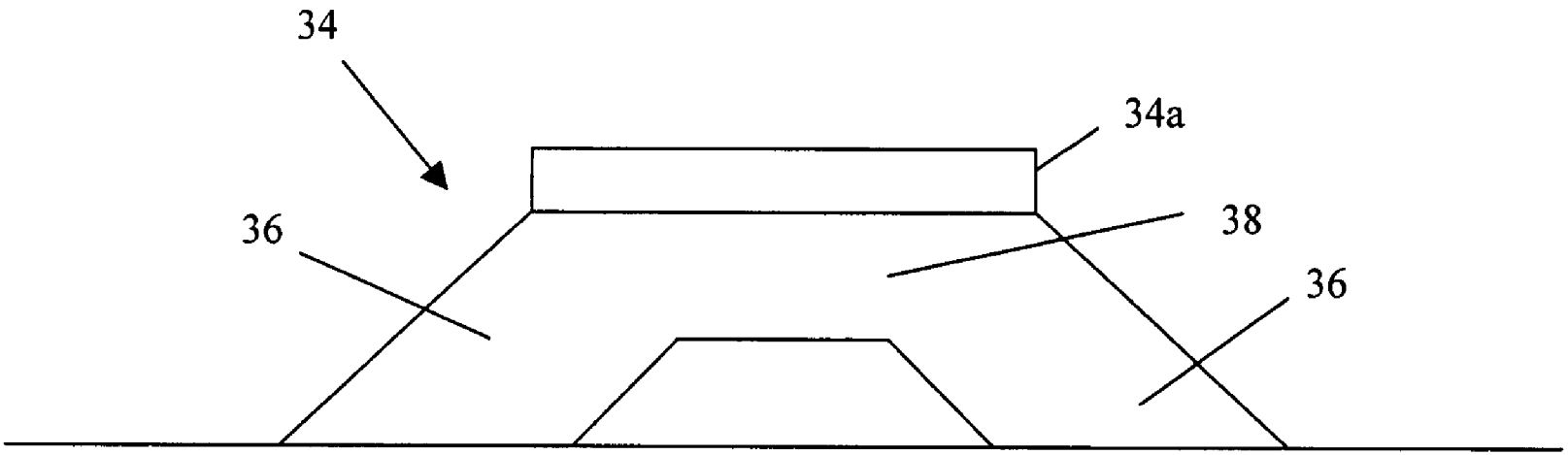
FIG. 17 is a side view of an exemplary tab extension configuration according to the present invention in which a single tab extension extends across the entire tip of a single tab.
Figure 18:
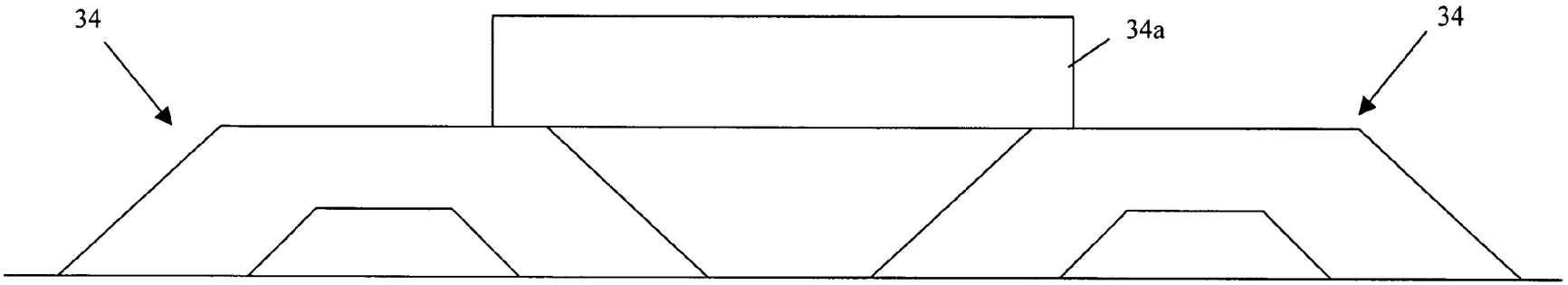
FIG. 18 is a side view of an exemplary tab extension configuration according to the present invention in which a single tab extension extends between two adjacent tabs.

FIG. 14 illustrates a cross-sectional view of an exemplary closure 21 according to the present invention engaged with a container 10. The tab extensions 34*a* may be designed to fit a number of different profiles to provide tamper evidence for a number of different types of containers. In this regard, the closure 21 may not need to be re-designed to accommodate multiple profiles.

According to another exemplary embodiment of the present invention, the tab extensions may be provided on only a select few tabs. In this regard, some tabs may be provided with a tab extension and some tabs may lack a tab extension. For example, a tab extension may be provided on every other tab so that an alternating sequence of tabs with a tab extension and tabs without a tab extension may be realized.

According to another exemplary embodiment of the present invention, the tab extensions of the tabs of a single closure may be non-uniform in size and shape. For example, some tab extensions may be trapezoidal in shape and some tab extensions may be bell-shaped.

According to another exemplary embodiment of the present invention, each tab may include a plurality of tab extensions, whose placement may differ on the tab. For example, each tab may be provided with two tab extensions placed on distal ends of the transverse member of the tab, or alternatively, the two tab extensions may be provided opposite edges of the transverse edge so that they face each other and are separated only by the width of the transverse member.

FIGS. 15 to 18 illustrate in a side view exemplary tab extension configurations according to the present invention. It will appreciated that many alternative tab extension configurations may be provided.

Closures 20 and 21, and container 10 may be formed from any suitable materials and may be constructed using any suitable processes. Closures 20 and 21 may be unitary members (including tamper indicating band 30) and may be made of plastic. Example plastics may include polypropylene and polyethylene. Closures 20 and 21 may be formed by compression or injection molding. Container 10 may also be a unitary member formed of either glass or plastic, including, for example, polyethylene terephthalate ("PET"), polypropylene, and polyethylene. Container 10 may be formed using a blow molding process, and in particular if PET is employed then container 10 may be stretch blow molded. Tabs 34 may be folded using any suitable process. However, tabs 34 may be folded by punch pressing tabs 34 upwardly.

The device according to the present invention has been described with respect to several exemplary embodiments. It can be understood, however, that there are many other variations of the above-described embodiments which will be apparent to those skilled in the art, even where elements have not explicitly been designated as exemplary. For example, closure 20 may include an annular sealing ring 50 to help seal the contents of the container 10 from contamination or spoiling. Similarly, closure 20 may include a plurality of ridges on the outer surface of skirt 24 to provide a frictional gripping surface for the consumer. It is understood that these and other modifications are within the teaching of the present invention, which is to be limited only by the claims appended hereto.

What is claimed is:

1. A tamper indicating band for a closure, comprising:

a plastic ring;

a plurality of plastic trapezoidal tabs disposed on the ring, each having a transverse member and extending members, a maximum thickness of the transverse member being substantially equal to a maximum thickness of a tip of each extending member when said thicknesses are measured in the same direction, and each of the tabs having a trapezoidal hole therethrough, each of the tabs formed in a downward direction and constructed to fold to a stable inward and upward orientation; and a tab extension arranged on at least one of the transverse member and at least one extending member of at least one tab and extending in a direction of extension of the extending members from the at least one tab, the tab extension configured to engage at least one container profile, a thickness of the tab extension in a direction perpendicular to the direction of extension less than the maximum thickness of the tip of the extending member.

2. The tamper indicating band according to claim 1, wherein the trapezoidal hole is located at a base of the trapezoidal tab.

3. The tamper indicating band according to claim 2, wherein the plurality of tabs are arranged circumferentially around the ring.

4. The tamper indicating band according to claim 3, wherein each of the tabs gradually thickens in a direction toward a tip of the extending members.

5. The tamper indicating band according to claim 3, wherein the plurality of tabs are spaced apart from one another along the ring.

6. A tamper indicating closure for a container, comprising:

a top wall;

an annular skirt depending from the top wall, the annular skirt including an internal thread; and a tamper indicating band connected to the skirt along a frangible line, the tamper indicating band including:

a plastic ring;

a plurality of plastic tabs each connected to the ring at a base, each of the tabs including a pair of extending members angled toward each other and joined by a transverse member having a maximum thickness substantially equal to a maximum thickness of a tip of each extending member when said thicknesses are measured in the same direction, each of the tabs formed in a downward orientation and constructed to fold to a stable inward and upward orientation; and a tab extension arranged on at least one of the transverse member and at least one extending member of at least one tab and extending in a direction of extension of the extending members from the at least one tab, the tab extension configured to engage at least one container profile, a thickness of the tab extension in a direction perpendicular to the direction of extension less than the maximum thickness of the tip of the extending member.

7. The tamper indicating closure according to claim 6, wherein the plurality of tabs are arranged circumferentially around the ring.

8. The tamper indicating closure according to claim 7, wherein each of the tabs gradually thickens in a direction toward a tip of the extending members.

9. The tamper indicating closure according to claim 7, wherein the plurality of tabs are spaced apart from one another along the ring.

10. A tamper indicating closure and container, comprising:

a container having a cylindrical neck, the neck including an external thread and a shoulder below the external thread; and a closure, including:

a top wall;

an annular skirt depending from the top wall, the annular skirt including an internal thread; and a tamper indicating band connected to a bottom edge of the skirt along a frangible line, the tamper indicating band including:

a plastic ring;

a plurality of plastic tabs each connected to the ring at a base, each of the tabs including a pair of extending members angled toward each other and joined by a transverse member having a maximum thickness substantially equal to a maximum thickness of a tip of each extending member when said thicknesses are measured in the same direction, each of the tabs formed in a downward orientation and constructed to fold to a stable inward an upward orientation; and a tab extension arranged on at least one of the transverse member and at least one extending member of at least one tab and extending in a direction of extension of the extending members from the at least one tab, the tab extension configured to engage at least one container profile, wherein the tabs and the tab extensions are arranged to lock under the container shoulder when closure is applied to the container, the tabs and the tab extensions arranged to contact the shoulder when the closure is removed so that the tamper indicating band separates from the skirt along the frangible line.

11. The closure and container according to claim 10, wherein the plurality of tabs are arranged circumferentially around the ring.

12. The closure and container according to claim 11, wherein each of the tabs gradually thickens in a direction toward a tip of the extending members.

13. The closure and container according to claim 11, wherein the plurality of tabs are spaced apart from one another along the ring.

14. A tamper indicating closure for a container, comprising:

a top wall;

an annular skirt depending from the top wall, the annular skirt including an internal thread; and a tamper indicating band connected to the skirt along a frangible line, the tamper indicating band including:

a plastic ring;

a plurality of plastic tabs each connected to the ring at a base, each of the tabs including a pair of extending members angled toward each other and joined by a transverse member having a maximum thickness substantially equal to a maximum thickness of a tip of each extending member when said thicknesses are measured in the same direction, each of the tabs formed in a downward orientation and constructed to fold to a stable inward and upward orientation; and a tab extension arranged on at least one of the transverse member and at least one extending member of at least one tab and extending in a direction of extension of the extending members from the at least one tab, the tab extension configured to engage at least one container profile, a thickness of the tab extension in a direction perpendicular to the direction of extension less than the maximum thickness of the tip of the extending member.

15. The tamper indicating closure according to claim 14, wherein the plurality of tabs are arranged circumferentially around the ring.

16. The tamper indicating closure according to claim 15, wherein each of the tabs gradually thickens in a direction toward a tip of the extending members.

17. The tamper indicating closure according to claim 15, wherein the plurality of tabs are spaced apart from one another along the ring.

18. A tamper indicating band for a closure, comprising a ring;

a plurality of tabs each connected to the ring at a base, the tabs including a pair of extending members angled toward each other and joined by a transverse member, the tab formed in a downward orientation and constructed to fold to a stable inward and upward orientation; and a tab extension arranged on at least one of the transverse member and at least one extending member of at least one tab and extending in a direction of extension of the extending members from the at least one tab, the tab extension configured to engage at least one container profile, a thickness of the tab extension in a direction perpendicular to the direction of extension less than a maximum thickness of a tip of the extending member from which the tab extension extends.

19. A tamper indicating band for a closure, comprising:

a ring;

a plurality of trapezoidal tabs disposed on the ring, each having a trapezoidal hole therethrough, the tabs formed in a downward orientation and constructed to fold to a stable inward and upward orientation; and a tab extension arranged on at least one tab extending in a direction of extension of the at least one tab and configured to engage at least one container profile, a thickness of the tab extension in a direction perpendicular to the direction of extension less than a maximum thickness of a tip of the extending member from which the tab extension extends.

20. A tamper indicating closure for a container, comprising:

a top wall;

an annular skirt depending from the top wall, the annular skirt including an internal thread; and a tamper indicating band connected to the skirt along a frangible line, the tamper indicating band including:

a ring;

a plurality of tabs each connected to the ring at a base, the tabs including a pair of extending members angled toward each other and joined by a transverse member, the tab formed in a downward orientation and constructed to fold to a stable inward and upward orientation; and a tab extension arranged on at least one of the transverse member and at least one extending member of at least one tab and extending in a direction of extension of the extending members from the at least one tab, the tab extension configured to engage at least one container profile, a thickness of the tab extension in a direction perpendicular to the direction of extension less than a maximum thickness of a tip of the extending member from which the tab extension extends.

21. A tamper indicating closure and container, comprising:

a container having a cylindrical neck, the neck including an external thread and a shoulder below the external thread; and a closure, including:

a top wall;

an annular skirt depending from the top wall, the annular skirt including an internal thread; and a tamper indicating band connected to a bottom edge of the skirt along a frangible line, the tamper indicating band including:

a ring;

a plurality of tabs each connected to the ring at a base, the tabs including a pair of extending members angled toward each other and joined by a transverse member, the tab formed in a downward orientation and constructed to fold to a stable inward and upward orientation; and a tab extension arranged on at least one of the transverse member and at least one extending member of at least one tab and extending in a direction of extension of the extending members from at least one tab, the tab extension configured to engage at least one container profile, the tabs and the tab extensions configured to lock under the container shoulder when the closure is applied to the container and contact the shoulder when the closure is removed so that the tamper indicating band separates from the skirt along the frangible line.

22. The tamper indicating closure and container according to claim 10, wherein a thickness of the tab extension in a direction perpendicular to the direction of extension is less than the maximum thickness of the tip of the extending member.

23. The tamper indicating closure and container according to claim 21, wherein a thickness of the tab extension in a direction perpendicular to the direction of extension is less than a maximum thickness of a tip of the extending member from which the tab extension extends.

24. A tamper indicating band for a closure, comprising:

a plastic ring;

a plurality of plastic trapezoidal tabs disposed on the ring, each having a transverse member and extending members, and each of the tabs having a trapezoidal hole therethrough, each of the tabs formed in a downward direction and constructed to fold to a stable inward and upward orientation; and a tab extension arranged on at least one of the transverse member and at least one extending member of at least one tab and extending in a direction of extension of the extending members from the at least one tab, the tab extension configured to engage at least one container profile, a thickness of the tab extension in a direction perpendicular to the direction of extension less than the maximum thickness of the tip of the extending member.

25. The tamper indicating closure and container according to claim 1, wherein the tab extension has a trapezoidal shape.

* * * * *

UNITED STATES PATENT AND TRADEMARK OFFICE

CERTIFICATE OF CORRECTION

PATENT NO. : 7,344,039 B2
APPLICATION NO. : 10/752074
DATED : March 18, 2008
INVENTOR(S) : Frederick L. Bixler et al.

It is certified that error appears in the above-identified patent and that said Letters Patent is hereby corrected as shown below:

Title Page;

On the cover sheet at (54) and at the top of Column 1, the title of the invention should be changed to --TAMPER INDICATING CLOSURE WITH FOLDABLE TAB--

Signed and Sealed this

Twelfth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,344,039 B2
APPLICATION NO. : 10/752074
DATED : March 18, 2008
INVENTOR(S) : Robin Annette Hylton It is certified that error appears in the above-identified patent and that said Letters Patent is hereby corrected as shown below:

On the title page of the patent, and column 1, line 8 please insert the following:

-- Related U.S. Application Data

(63) Continuation-in-part of application No. 10/041,398, filed on January 8, 2002, now Pat. No. 6,673,298, which is a divisional of application No. 09/131,371, filed August 7, 1998, now Pat. No. 6,371,317. --

Signed and Sealed this

Seventh Day of October, 2008

JON W. DUDAS
*Director of the United States Patent and Trademark Office*